US010539140B2

(12) United States Patent
Keitel et al.

(10) Patent No.: US 10,539,140 B2
(45) Date of Patent: Jan. 21, 2020

(54) PUMP HOUSING OF A MAGNETIC AND A NON-MAGNETIC MATERIAL

(71) Applicant: HERAEUS DEUTSCHLAND GMBH & CO. KG, Hanau (DE)

(72) Inventors: Oliver Keitel, Aschaffenburg (DE); Jörg-Martin Gebert, Karlsruhe (DE)

(73) Assignee: Heraeus Deutschland GmbH & Co. KG, Hanau (DE)

( * ) Notice: Subject to any disclaimer, the term of this patent is extended or adjusted under 35 U.S.C. 154(b) by 552 days.

(21) Appl. No.: 14/900,515

(22) PCT Filed: Jun. 20, 2014

(86) PCT No.: PCT/EP2014/001686
§ 371 (c)(1),
(2) Date: Dec. 21, 2015

(87) PCT Pub. No.: WO2014/202227
PCT Pub. Date: Dec. 24, 2014

(65) Prior Publication Data

US 2016/0369805 A1 Dec. 22, 2016

(30) Foreign Application Priority Data

Jun. 21, 2013 (DE) ..... 10 2013 211 844

(51) Int. Cl.
*F04D 13/06* (2006.01)
*F04D 29/02* (2006.01)
(Continued)

(52) U.S. Cl.
CPC ..... *F04D 13/0606* (2013.01); *F04D 3/00* (2013.01); *F04D 13/024* (2013.01);
(Continued)

(58) Field of Classification Search
CPC .. A61M 1/101; A61M 1/1012; A61M 1/1015; A61M 1/1031; A61M 1/122;
(Continued)

(56) References Cited

U.S. PATENT DOCUMENTS 3,608,088 A 9/1971 Dorman et al.
3,932,069 A 1/1976 Giardini et al.
(Continued)

FOREIGN PATENT DOCUMENTS

CN 1491323 4/2004
CN 1609455 4/2005
(Continued)

OTHER PUBLICATIONS

International Search Report and Written Opinion for International Application No. PCT/EP2014/001686 dated Mar. 12, 2014 (13 pages).
(Continued)

*Primary Examiner* — Dwayne J White
*Assistant Examiner* — Adam W Brown
(74) *Attorney, Agent, or Firm* — Dicke, Billig & Czaja, PLLC

(57) ABSTRACT

One aspect of the invention relates to a pump device comprising an impeller; a pump housing surrounding an interior region and having an inlet and an outlet. The impeller is provided in the interior region of the pump housing. The wall of the pump housing has at least one first subregion and at least two further subregions in at least one plane perpendicular to the longitudinal extension of the pump housing. The at least one first subregion comprises at least 60% by weight, based on the total mass of the at least one first subregion, of at least one nonmagnetic material. The further subregions comprise at least 41% by weight, based on the total mass of the further subregions, of at least
(Continued)

one ferromagnetic material, wherein each further subregion is adjacent to at least one first subregion in the plane.

16 Claims, 4 Drawing Sheets

(51) Int. Cl.
*F04D 29/52* (2006.01)
*F04D 3/00* (2006.01)
*F04D 13/02* (2006.01)
*F04D 29/18* (2006.01)

(52) U.S. Cl.
CPC ..... *F04D 29/026* (2013.01); *F04D 29/181* (2013.01); *F04D 29/528* (2013.01); *F05D 2230/20* (2013.01); *F05D 2230/40* (2013.01); *F05D 2300/10* (2013.01); *F05D 2300/133* (2013.01); *F05D 2300/17* (2013.01); *F05D 2300/20* (2013.01); *F05D 2300/507* (2013.01)

(58) Field of Classification Search
CPC ..... B22F 1/0059; B22F 3/004; B22F 3/16; B22F 5/10; B22F 7/008; B22F 7/06; B22F 2301/25; B22F 2302/253; B22F 2304/10; B22F 2998/10; B28B 1/24; C04B 37/021; C04B 2237/343; C04B 2237/408; C22C 29/00; C22C 32/00; C22C 32/0021; F04D 3/00; F04D 13/024; F04D 13/0606; F04D 29/026; F04D 29/181; F04D 29/528; F05B 2240/142; F05B 2240/30; F05B 2280/103; F05B 2280/10304; F05B 2280/2004; F05B 2280/20041; F05B 2280/20043; F05D 2230/20; F05D 2230/40; F05D 2300/10; F05D 2300/133; F05D 2300/17; F05D 2300/20; F05D 2300/21; F05D 2300/507
See application file for complete search history.

(56) References Cited

U.S. PATENT DOCUMENTS 4,603,062 A 7/1986 Ecer
4,806,080 A * 2/1989 Mizobuchi ..... B24C 1/04 384/123
5,112,200 A 5/1992 Isaacson et al.
5,370,509 A 12/1994 Golding et al.
5,470,208 A * 11/1995 Kletschka ..... F04D 5/001 415/900
5,641,276 A 6/1997 Heidelberg et al.
5,822,839 A 10/1998 Ghosh et al.
5,840,070 A 11/1998 Wampler
5,990,588 A 11/1999 Kliman et al.
6,048,363 A * 4/2000 Nagyszalanczy ... A61M 1/1086 415/900
6,053,705 A * 4/2000 Schob ..... A61M 1/101 417/356
6,058,593 A 5/2000 Siess
6,158,984 A 12/2000 Cao et al.
6,227,817 B1 * 5/2001 Paden ..... F04D 13/0646 417/356
6,234,772 B1 * 5/2001 Wampler ..... F04D 29/047 417/423.12
6,499,209 B1 12/2002 Landin et al.
6,663,362 B1 12/2003 Lentz et al.
6,717,311 B2 * 4/2004 Locke ..... F16C 32/0444 310/90.5
7,229,258 B2 * 6/2007 Wood ..... F16C 32/044 417/355
8,007,254 B2 * 8/2011 LaRose ..... A61M 1/101 417/356
8,641,594 B2 2/2014 LaRose et al.
8,821,365 B2 * 9/2014 Ozaki ..... F04D 13/0666 600/16
8,864,643 B2 10/2014 Reichenbach et al.
9,850,906 B2 * 12/2017 Ozaki ..... F04D 13/0693
2004/0062664 A1 4/2004 Weigold et al.
2005/0279847 A1 12/2005 Kim
2006/0127253 A1 * 6/2006 Ekberg ..... H02K 1/278 417/420
2007/0156006 A1 7/2007 Smith et al.
2009/0022610 A1 1/2009 Materne et al.
2012/0029265 A1 2/2012 LaRose et al.
2012/0091832 A1 4/2012 Soderberg
2012/0098371 A1 * 4/2012 Pinneo ..... F16C 32/0442 310/90.5
2013/0096364 A1 4/2013 Reichenbach et al.
2016/0369813 A1 12/2016 Schibli et al.
2016/0369814 A1 12/2016 Schibli et al.
2017/0102001 A1 4/2017 Schibli et al.

FOREIGN PATENT DOCUMENTS

CN 102387881 3/2012
DE 29723409 10/1998
DE 29907332 10/1999
DE 19956380 1/2001
DE 10108810 8/2002
DE 102006008423 8/2007
DE 10164898 9/2010
DE 112011102347 5/2013
DE 112011102354 5/2013
EP 2236229 6/2010
JP 2010-279490 12/2010
JP WO 2012132850 A1 * 10/2012 ..... F04D 13/0666
WO 9811650 3/1998
WO 0064030 10/2000
WO 2010050114 5/2010
WO 2010119267 10/2010
WO 2014202225 12/2014
WO 2014202226 12/2014
WO 2014202227 12/2014

OTHER PUBLICATIONS

Office Action dated Aug. 20, 2019 in parallel U.S. Appl. No. 15/128,921.
Office Action dated Apr. 5, 2019 in parallel U.S. Appl. No. 15/128,921.
International Preliminary Report on Patentability for International Application No. PCT/EP2015/056137 dated Oct. 6, 2016 (20 pgs).
International Search Report and Written Opinion for International Application No. PCT/EP2015/056137 dated Sep. 2, 2015 (21 pgs).
Office Action dated Jan. 17, 2018 in parallel U.S. Appl. No. 14/900,513.
Final Office Action dated Aug. 8, 2018 in parallel U.S. Appl. No. 14/900,513.
Office Action dated Dec. 20, 2018 in parallel U.S. Appl. No. 14/900,513.
Final Office Action dated May 30, 2019 in parallel U.S. Appl. No. 14/900,513.
Office Action dated Jan. 17, 2018 in parallel U.S. Appl. No. 14/900,509.
Final Office Action dated Aug. 27, 2018 in parallel U.S. Appl. No. 14/900,509.
Office Action dated Apr. 23, 2019 in parallel U.S. Appl. No. 14/900,509.
Search Report for International Application No. PCT/EP2014/001684 dated Oct. 24, 2014 (2 pgs.).
International Search Report and Written Opinion for International Application No. PCT/EP2014/001685 dated Oct. 24, 2010 (7 pgs.).
Polyurethanes and Medical Applications, American Chemistry Council, Retrieved on Mar. 26, 2019. Retrieved from the Internet: URL: https://polyurethane.americanchemistry.com/Polyurethanes-and-Medical-Applications, year 2019.
Molecular Weight of Aluminum Oxide, ConvertUnits.com (retrieved on Feb. 20, 2019). Retrieved from the Internet: URL: www.convertunits.com/molarmass/Aluminum+Oxide, year 2019.

(56) References Cited

OTHER PUBLICATIONS

Aluminum Oxide (Ai2O3) Balls, RGPBALLS S.r.l. 2019 (retrived on Mar. 14, 2019). Retrieved from the Internet: URL: www.rgpballs.com/en/aluminum-oxide-al2o3-balls/, year 2019.
Ashby, et al. Materials and Design: The Art and Science of Material Selection in Product Design, p. 218 (online), Second Edition, Elsevier 2002 (retrieved on Mar. 4, 2019). Retrieved from the Internet: URL: https://books.google.com/books?isbn=0080949401, year 2002.
Magnetic Permeability, Dura Magentics, Inc. Aug. 5, 2015 Retrieved on Mar. 25, 2019. Retrieved from the Internet: URL httpps:///www.duramag.com/techtalk/tech-briefs/magnetic-permeability-why-are-some-materials-attracted-by-a-magnet-and-others-are-not, year 2015.
Translation of the Written Opinion of the International Searching Authority for International Application No. PCT/EP2014/001684 dated Oct. 24, 2014 (6 pgs.).

* cited by examiner

PUMP HOUSING OF A MAGNETIC AND A NON-MAGNETIC MATERIAL

BACKGROUND

One aspect of the invention relates to a pump device comprising i. an impeller; ii. a pump housing which at least partly surrounds an interior region and has an inlet and an outlet, wherein the impeller is provided in the interior region of the pump housing; wherein the wall of the pump housing has at least one first subregion and at least two further subregions in at least one plane (Q) perpendicular to the longitudinal extension of the pump housing; wherein the at least one first subregion comprises at least one nonmagnetic material, wherein the further subregions each comprise at least one ferromagnetic material, wherein each further subregion is adjacent to at least one first subregion in the plane (Q) and wherein the at least one first subregion and the further subregions are connected to one another in a material-fitting manner. One aspect of the invention further relates to a housing which comprises the features described for the pump housing.

One aspect of the invention also relates to a process for producing a pump housing, which comprises the steps: a. provision of a first material; b. provision of a further material; c. formation of a pump housing precursor, wherein at least one first subregion of the pump housing is made of the first material and wherein at least two further subregions of the pump housing are made of the further material; and d. treatment of the pump housing precursor at a temperature of at least 300° C.

Pump devices having rotors or impellers are known. Some pump devices have a pump housing in the form of a tube as transport section for a fluid to be pumped. An impeller which, for example, is driven by a motor located outside the transport section by means of a drive shaft is frequently located therein. The pump housing is fastened by means of one or more holding elements to the pump device. This type of attachment can have various disadvantages. Firstly, an additional working step is required for attaching the holder. This increases production costs and is inefficient in terms of resources. Furthermore, the connection between the pump housing and the holder is not without tension as a result of the method of production or because of the connecting means used, e.g. screws or rivets. This is due to the fact that materials different from those of the pump housing are usually selected for the holders and/or connecting means. Due to these tensions, the connections of the holder to the pump housing deteriorate over time. In addition, it is extremely important for space to be saved, especially for very small pumps. This applies particularly to pumps which are to be implanted in a body. A space-saving construction is more difficult to realize for pumps having many individual parts than in the case of a pump having a smaller number of individual parts.

In general, it is an object of the present invention to at least partly overcome the disadvantages of the prior art.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Further measures and advantages of the invention are evident from the claims, the description provided hereinafter, and the drawings. The invention is illustrated through several exemplary embodiments in the drawings. In this context, equal or functionally equal or functionally corresponding elements are identified through the same reference numbers. The invention shall not be limited to the exemplary embodiments.

DETAILED DESCRIPTION

Figure 1:
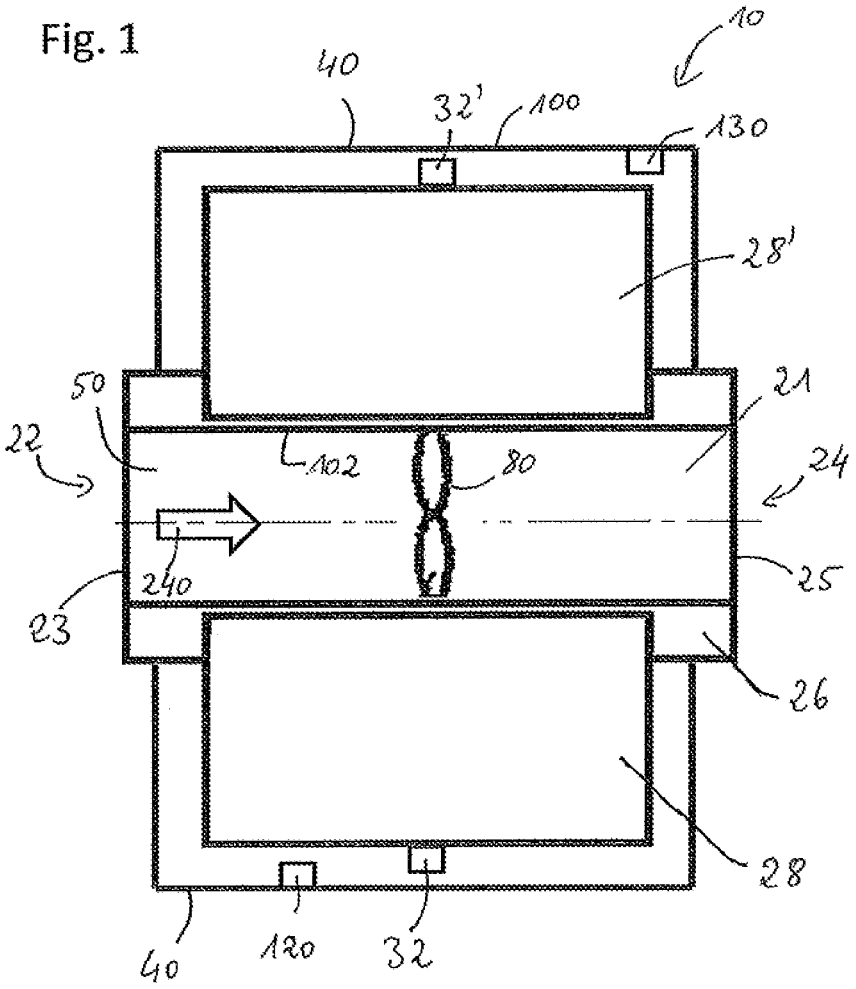
FIG. 1 schematically illustrates a pump device according to one embodiment of the invention.

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

A further object of one embodiment is to provide a pump device whose materials are as biocompatible as possible, as easily processible as possible, as corrosion resistant as possible and can be durably connected to one another.

A further object of one embodiment is to provide a pump device which is designed as space-saving as possible.

A further object of one embodiment is to provide a pump device which can be operated in an energy-saving manner.

Furthermore, it is an object of one embodiment of the invention to provide a pump device being as tension-free as possible, in particular having a housing or pump housing being as tension-free as possible, and in particular to provide a passage from the pump housing to the remaining part of the pump device being as tension-free as possible.

An additional object is to provide a pump device which has, during use, an abrasion of the movable parts and the mountings thereof as low as possible.

In addition, it is an object of one embodiment of the invention to provide a pump housing for a pump device which can be integrated in an as simply and as space-saving manner as possible into other components, e.g. a component housing of the pump device.

In addition, it is an object of one embodiment of the invention to provide a pump housing for a pump device which can be joined to a component housing of the pump device in a hermetically sealed manner.

Furthermore, it is an object of one embodiment of the invention to provide a housing or pump housing which is as free as possible of internal and/or external tensions.

Furthermore, it is an object of one embodiment of the invention to provide a process by means of which a pump housing can be produced in a manner being as cost-saving and as time-saving as possible.

It is also an object of one embodiment of the invention to provide a component housing which has a highly space-saving configuration.

A further object is to provide a housing which can be connected in a hermetically sealed manner to other components.

A first object of one embodiment of the present invention is a pump device comprising:

i. an impeller;

ii. a pump housing which at least partly surrounds an interior region and has an inlet and an outlet, wherein the impeller is provided in the interior region of the pump housing;

wherein the wall of the pump housing has at least one first subregion and at least two further subregions in at least one plane perpendicular to the longitudinal extension of the pump housing;

wherein the at least one first subregion comprises at least 60% by weight, based on the total mass of the at least one first subregion, of at least one nonmagnetic material, wherein the further subregions comprise at least 41% by weight, based on the total mass of the further subregions, of at least one ferromagnetic material, wherein each further subregion is adjacent to at least one first subregion in the plane and wherein the at least one first subregion and the further subregions are connected to one another in a material-fitting manner.

The pump device of one embodiment of the invention is preferably suitable for being introduced into the body of a human being or an animal. The pump device of one embodiment of the invention is also preferably designed for conveying body fluids such as blood, serum, plasma, interstitial liquid, saliva or urine. In particular, the pump device of one embodiment of the invention is preferably introduced into the blood stream of a human being or animal in order to pump blood. The introduction of the pump device of one embodiment of the invention can, for example, comprise implantation into the body, placing on the body or connection to the body.

The pump housing of the pump device of one embodiment of the invention can have any shape which a person skilled in the art would select for use in a pump device. The pump housing preferably has at least one wall of the pump housing, hereinafter also referred to as pump housing wall. The at least one wall of the pump housing surrounds the interior region of the pump housing. The pump housing has at least two ends, with at least one inlet being arranged at one end and at least one outlet being arranged at the other end. The interior region of the pump housing is, apart from the inlet and outlet of the pump housing, completely surrounded by the wall. The pump housing can partly extend beyond the interior region of the pump housing. The pump housing preferably ends at the inlet or outlet.

The side of the pump housing facing away from the interior region will be referred to as the exterior of the pump housing. The pump housing preferably has an elongated shape. The shape of the pump housing is defined by a longitudinal extension and at least one cross section. A cross section of the pump housing is always determined in a plane perpendicular to the pump housing wall. If the pump housing wall is curved in its longitudinal extension, a cross section is determined perpendicular to the tangent at a point on the pump housing wall. The longitudinal extension is considered to be the extension of the pump housing in the pumping direction. The shortest, imaginary connecting line between the inlet and outlet within the pump housing is always applicable. The pump housing wall, also referred to as wall, extends in the direction of the longitudinal extension of the pump housing. The at least one wall can have one or more wall areas. If the pump housing has more than one wall area, these are connected via corners at which the wall areas come together. The wall, and preferably also the wall areas, of the pump housing preferably run parallel to the longitudinal extension of the pump housing. Part of the pump housing wall can extend beyond the interior region of the pump housing. The pump housing wall preferably extends over the entire interior region of the pump housing.

If the pump housing has a tubular shape, the inlet is located at the first end and the outlet is located at the opposite end of the pump housing. At least part of the pump housing wall preferably ends at the ends of the pump housing. The part of the pump housing which extends beyond the interior region into the surroundings is referred to as pump housing tongue. In a preferred embodiment of the pump device of one embodiment of the invention, the pump housing has a first opening into the interior region at the first end, i. e. the inlet, and a further opening into the interior region at the further end, i. e. the outlet. The pump housing is fluidically connected to its surroundings via inlet and outlet. The openings at the ends of the pump housing make it possible for a fluid to flow through the interior region of the pump housing. The fluid is, for example, a gas, a liquid such as blood or a mixture thereof. The first opening preferably serves as point of introduction of the fluid to be conveyed in the interior region of the pump housing and the further opening serves as point of discharge of the fluid to be conveyed. The pump housing can have further openings, for example in the wall of the pump housing. These further openings can serve for the additional introduction of fluid or, on the other side, for the branched discharge of fluid. If the pump device of one embodiment of the invention is implanted in a body, for example in order to assist the flow of blood and thus take load off the heart, the pump device of one embodiment of the invention is connected via conduits to blood vessels of the body.

The pump housing comprises at least one cross section which is preferably selected from the group consisting of circular, rectangular, polygonal and ellipsoidal. The pump housing preferably has a longitudinal shape at least in one first section. Furthermore, the pump housing can comprise at least one further section whose shape is different from that of the first section of the pump housing.

The total length of the pump housing is preferably from 1.5 to 10 times, preferably from 2 to 9 times or preferably from 2.5 to 8.5 times, longer than the diameter of the pump housing. The length of the pump housing is preferably determined along the outer wall of the pump housing in the pumping direction. The pump housing preferably has a length in the range from 1 mm to 10 cm, or preferably in the range from 2 mm to 8 cm, or preferably in the range from 5 mm to 5 cm. The pump housing preferably has an internal diameter in the range from 0.1 to 50 mm, or preferably in the range from 0.5 to 30 mm, or preferably in the range from 1 to 20 mm.

The wall, in particular the at least one wall area of the pump housing, is preferably smooth. Smooth means that the wall of the pump housing has a roughness in the range from 0.025 to 4 Ra, or preferably in the range from 0.05 to 3 Ra, or preferably in the range from 0.07 to 1 Ra.

The pump housing comprises at least one first subregion and at least one further subregion. The first subregion and the further subregion differ in terms of their composition. The at least one first subregion preferably has at least one, particularly preferably all, of the following properties:

- a heat resistance as high as possible;
- a pressure resistance as high as possible;
- a hardness as high as possible;
- a resistance to acids and bases as high as possible;
- a roughness as low as possible;
- a connectability to a metal-ceramic mixture (cermet) as tension-free as possible;
- a sinterability to a metal-ceramic mixture (cermet) as good as possible;
- a connectability to a metal as good as possible;
- a weldability to a meta as good as possible I;
- an electrical conductivity as low as possible;
- a magnetic permeability as low as possible.

The at least two further subregions preferably have at least one, particularly preferably all, of the following properties:

- a heat resistance as high as possible;
- a pressure resistance as high as possible;
- a hardness as high as possible;
- a resistance to acids and bases as high as possible;
- a roughness as low as possible;
- a sinterability to a ceramic material or a metal-ceramic mixture (cermet) as high as possible;
- an electrical conductivity as high as possible;
- a magnetic permeability as high as possible.

If the at least one first subregion and the further subregions are brought together in the production of the pump housing, it is possible to obtain a pump housing which combines the one or more listed properties for the at least one first subregion and the at least two further subregions. At least part of the at least one first subregion is connected to at least part of the further subregions. The connection can be a direct connection of the two subregions or an indirect connection. The at least one first subregion and the at least two further subregions are connected to one another in a material-fitting manner.

A material-fitting connection is present when the materials properties of the first subregion go over smoothly into the materials properties of the further subregion. There is no sharp boundary between the two adjoining subregions. Rather, there is a transition region in which the properties of the two adjoining subregions mix. This transition region is, in the case of an indirect connection, also referred to as third subregion. In this third subregion, both the materials of the first subregion and at least partly the materials of the further subregion are present side by side and preferably form a blending of the materials. The materials of the two subregions preferably enter bonds on an atomic or molecular level. Forces on an atomic or molecular level act on the materials of the first and further subregions. Such a material-fitting connection can generally only be released by destruction of the pump housing. Material-fitting connections are usually achieved by sintering or adhesive bonding of materials.

The at least one first subregion comprises at least 60% by weight, preferably at least 70% by weight, or preferably at least 90% by weight, based on the total mass of the first subregion, of a nonmagnetic material. This is preferably a nonmagnetic ceramic or a nonmagnetic metal. For the purposes of one embodiment of the present invention, a nonmagnetic material is a material which has a magnetic permeability of less than 2μ, i.e. has no ferromagnetic properties. For the purposes of one embodiment of the present invention, a ferromagnetic material is a material which has a magnetic permeability of more than 2μ.

The at least one first subregion preferably comprises the ceramic in a proportion of from 60 to 100% by weight, or preferably in a proportion of from 70 to 100% by weight, or preferably in a proportion of from 80 to 100% by weight, based on the total mass of the first subregion. Furthermore, the at least one first subregion preferably comprises the ceramic in a proportion of 100% by weight, based on the total mass of the first subregion.

The ceramic can be any ceramic which a person skilled in the art would select for the pump device of one embodiment of the invention. The ceramic is preferably selected from the group consisting of an oxide ceramic, a silicate ceramic, a nonoxidic ceramic and a mixture of at least two thereof.

The oxide ceramic is preferably selected from the group consisting of a metal oxide, a semimetal oxide and a mixture thereof. The metal of the metal oxide can be selected from the group consisting of aluminum, beryllium, barium, calcium, magnesium, sodium, potassium, iron, zirconium, titanium and a mixture of at least two thereof. The metal oxide is preferably selected from the group consisting of aluminum oxide ($Al_2O_3$), magnesium oxide (MgO), zirconium oxide ($ZrO_2$), yttrium oxide ($Y_2O_3$), aluminum titanate ($Al_2TiO_5$), a piezoceramic such as lead zirconate ($PbZrO_3$), lead titanate ($PbTiO_3$) or lead zirconate titanate (PZT) and a mixture of at least two thereof. The semimetal of the semimetal oxide is preferably selected from the group consisting of boron, silicon, arsenic, tellurium and a mixture of at least two thereof.

The silicate ceramic is preferably selected from the group consisting of a steatite ($Mg_3[Si_4O_{10}(OH)_2]$), cordierite ($(Mg, Fe^{2+})_2(Al_2Si)[Al_2Si_4O_{18}]$), mullite ($Al_2Al_{2+2x}Si_{2-2x}O_{10-x}$ where x=oxygen vacancies per unit cell), feldspar ($(Ba,Ca,Na,K,NH_4)(Al,B,Si)_4O_8$) and a mixture of at least two thereof.

The nonoxidic ceramic can be selected from the group consisting of a carbide, a nitride and a mixture thereof. The carbide can be selected from the group consisting of silicon carbide (SiC), boron carbide ($B_4C$), titanium carbide (TiC), tungsten carbide, cementite ($Fe_3C$). The nitride can be selected from the group consisting of silicon nitride ($Si_3N_4$), aluminum nitride (AlN), titanium nitride (TiN), silicon aluminum oxynitride (SIALON) and a mixture of at least two thereof.

The at least one first subregion and the at least two further subregions can be arranged in different ways within the pump housing. The housing preferably has the shape of a tube having a straight interior wall. Protuberances can project on the outer wall of the housing which is formed either by at least one of the at least one first subregions or by at least one of the at least two further subregions or by a combination of the two types of subregions. Examples of the arrangement of the various subregions in cross section including the protuberances are shown in FIGS. 3 and 4.

Each transition from one subregion to another subregion can, based on a cross section of the pump housing, be right-angled or have an angle different from 90°. Furthermore, each transition can also have an irregular configuration, i.e. viewed in cross section, no imaginary straight line can be drawn on the transition. In addition, each transition from one subregion to another subregion can, as an alternative or in addition to what has been described above and based on a longitudinal section through a wall of the pump housing, be right-angled or have an angle different from 90°. Furthermore, each transition can also have an irregular configuration, i.e. viewed in longitudinal section, no imaginary straight line can be drawn on the transition. Furthermore, combinations of the abovementioned configurations of a transition in cross section and in longitudinal section are preferred.

It is preferred that at least one surface of the at least one first subregion faces the interior region. The at least one first subregion or the at least two further subregions can in each case form the total wall thickness in a cross section in the plane of the pump housing at at least one position along the longitudinal extension of the pump housing. As an alternative, part of the wall thickness can comprise the first subregion and the other part of this wall thickness can comprise at least one further subregion. It is preferred that the at least one first subregion and the at least two further subregions are configured as sections perpendicular to or parallel to the longitudinal extension of the pump housing.

In a preferred embodiment of the pump housing of the pump device of one embodiment of the invention, the at least one first subregion completely surrounds at least one of the at least two further subregions. Preferably, the at least one first subregion completely surrounds all of the at least two further subregions. In a preferred embodiment of the pump housing of the pump device of one embodiment of the invention, at least one surface of the first subregion faces the outside of the pump housing.

In a preferred embodiment of the pump housing of the pump device of one embodiment of the invention, the at least one first subregion partly surrounds at least one of the at least two further subregions. Preferable, the at least one first subregion partly surrounds all of the at least two further subregions. In a preferred embodiment of the pump housing of the pump device of one embodiment of the invention, at least one surface of the first subregion and of the further subregion faces the outside of the pump housing.

In a further preferred embodiment of the pump housing of the pump device of one embodiment of the invention, at least the at least two further subregions point away in the form of protuberances in various spatial directions from the preferably cylindrical main element of the pump housing.

The pump device of one embodiment of the invention additionally comprises a rotor in the form of the impeller. The impeller can have any shape which a person skilled in the art would select for this purpose.

The impeller preferably has a diameter in the range from 1 mm to 10 cm, preferably in the range from 3 mm to 5 cm, or preferably in the range from 5 mm to 3 cm. The impeller preferably has a thickness in the range from 0.1 to 50 mm, preferably in the range from 0.5 to 20 mm, or preferably in the range from 1 to 15 mm. The diameter of the impeller is preferably smaller than the diameter of the pump housing in the plane of the impeller. The diameter of the impeller is preferably from 1 to 10% smaller, or preferably from 1.5 to 8% smaller, or preferably from 2 to 7% smaller, than the diameter of the pump housing, based on the diameter of the pump housing in the plane of the impeller.

The impeller preferably has at least two rotor blades, preferably at least three rotor blades, or preferably at least five rotor blades. The impeller particularly preferably has a number of rotor blades in the range from 2 to 20, preferably in the range from 5 to 15, or preferably in the range from 8 to 13. The impeller preferably has a central axis of rotation about which the impeller can be rotated. The axis of rotation will also be referred to as rotational axis. The at least two rotor blades are preferably arranged symmetrically around the axis of rotation of the impeller. The impeller is preferably arranged in the interior region of the pump housing, with the rotational axis of the impeller being provided parallel to the longitudinal extension of the wall of the tube.

The impeller can be made of any material which a person skilled in the art would select for use in the pump device of one embodiment of the invention. The impeller preferably has at least two regions: a first region in the center of the impeller around the rotational axis—this first region will also be referred to as core region —, a second region, also referred to as rotor region. This second region has at least two rotor blades which are suitable for conveying the fluid to be conveyed.

The impeller comprises at least one element which has hard-magnetic properties. A hard-magnetic property means that a material acquires permanent magnetization as a result of placing this material in a magnetic field. The strength of a magnetizing field is selected as a function of the composition of the element. The considerations and calculations required for this purpose will be well known to a person skilled in the art. When carrying out the magnetization, the induction of the impeller is preferably saturated. After the magnetic field has decreased, the magnetization of the hard-magnetic material remains. Materials having hard-magnetic properties can be used as permanent magnets. The at least one element is preferably arranged on the impeller in such a way that it moves the impeller when it is alternately attracted or repelled by two mutually independent electric or magnetic fields. The impeller preferably comprises at least two elements having hard-magnetic properties. Furthermore, the impeller can be controlled in respect of its radial or else axial alignment by means of at least one optional element. The elements having hard-magnetic properties are preferably utilized for mounting the impeller with as little contact as possible in the pump housing without further auxiliary means such as bearings or other fixings in the pump housing. This makes particularly low-friction and particularly low-wear operation possible.

The at least one element can, for example, be realized by means of at least one rotor blade which comprises a hard-magnetic material. As an alternative, a hard-magnetic element can be arranged on at least one rotor blade. The hard-magnetic element is preferably provided in the core of the impeller. The at least one hard-magnetic element preferably comprises at least one magnetizable material such as iron, cobalt, nickel, chromium dioxide or a mixture of at least two thereof. The at least one element can, for example, be arranged in the form of a coating composed of hard-magnetic material on at least one rotor blade or in the interior of the impeller. At least 50%, or preferably at least 70%, or preferably 100%, of the rotor blades preferably made up of a hard-magnetic material. The element preferably comprises at least 10% by weight, are/or preferably at least 20% by weight, or preferably at least 30% by weight, based on the total mass of the element, of a hard-magnetic metal. Furthermore, the element preferably comprises a cobalt-chromium alloy or a platinum-cobalt alloy, in particular a platinum-cobalt alloy (PtCo23) having a proportion of cobalt of 23% by weight, based on the total mass of the alloy, in an amount of from 10 to 100% by weight, or preferably in an amount of from 20 to 100% by weight, or preferably in an amount of from 30 to 100% by weight, based on the total mass of the element.

The impeller can have a different material in its core, i. e. the region around the axis of rotation, than in or on the rotor blades. As an alternative, the impeller can comprise a uniform material in the core and in the rotor blades. The material of the rotor blades can be flexible or inflexible. The material of the core of the impeller or the rotor blades of the impeller is in each case preferably selected from the group consisting of a polymer, a metal, a ceramic and a combination or mixture of at least two thereof.

The polymer can be selected from the group consisting of a chitosan, a fibrin, a collagen, a caprolactone, a lactide, a glycolide, a dioxanone, a polyurethane, a polyimide, a polyamide, a polyester, a polymethyl methacrylate, a polyacrylate, a Teflon, a copolymer of at least two thereof and a mixture of at least two thereof.

The metal can be selected from the group consisting of iron (Fe), stainless steel, platinum (Pt), iridium (Ir), niobium (Nb), molybdenum (Mo), tungsten (W), titanium (Ti), cobalt (Co), chromium (Cr), a cobalt-chromium alloy, tantalum (Ta), vanadium (V) and zirconium (Zr) and a mixture of at least two thereof, with particular preference being given to titanium, niobium, molybdenum, cobalt, chromium, tantalum, zirconium, vanadium and alloys thereof.

The ceramic can be selected from the group consisting of aluminum oxide ($Al_2O_3$), zirconium dioxide ($ZrO_2$), hydroxylapatite, tricalcium phosphate, glass-ceramic, aluminum oxide-reinforced zirconium oxide (ZTA), zirconium oxide-containing aluminum oxide (ZTA-Zirconia Toughened Aluminium-$Al_2O_3$/$ZrO_2$), yttrium-containing zirconium oxide (Y-TZP), aluminum nitride (AlN), titanium nitride (TiN), magnesium oxide (MgO), piezoceramic, barium (Zr, Ti) oxide, barium (Ce, Ti) oxide and sodium potassium niobate and a mixture of at least two thereof.

It is furthermore preferred that the impeller is coated on its outside, in particular on the outer surface of the rotor blades, with a biocompatible material. Suitable biocompatible materials are described further below.

The impeller is preferably arranged in the interior region of the pump housing which is surrounded by the first subregion. The impeller is preferably arranged with its rotational axis parallel to the longitudinal extension of the wall. Furthermore, the impeller can be aligned in the pump housing by means of a magnetic field. The impeller in the interior region of the pump housing is preferably aligned by means of magnetic fields of electric coils on the outside of the pump housing. The coils preferably comprise an electrically conductive material. The electrically conductive material of the coils is preferably selected from the group consisting of iron (Fe), copper (Cu), gold (Au), silver (Ag), platinum (Pt), palladium (Pd), titanium (Ti), chromium (Cr), cobalt (Co), tungsten (VV) and a mixture of at least two thereof. The electrically conductive material further preferably comprises copper (Cu). The pump device of one embodiment of the invention preferably comprises at least two coils, preferably at least three coils, or preferably at least four coils. The coils are preferably arranged on the outside of the pump housing, with the coils and the impeller preferably lying in one plane. They are then arranged on the outside of the pump housing around the impeller.

In a preferred embodiment of the pump device of one embodiment of the invention, at least part of each further subregion is surrounded by in each case at least one electric coil.

In a preferred embodiment of the pump device of one embodiment of the invention, the pump housing comprises a tube at least as a main element. The tube is preferably straight. As an alternative, the tube can have at least one bend. The tube is preferably closed except for an inlet and an outlet. This means that the tube has no further openings apart from the two openings at the inlet and the outlet. The dimensions, materials and configurations preferably otherwise correspond to those of the above-described pump housing.

In a preferred embodiment of the pump device of one embodiment of the invention, the nonmagnetic material of the at least one first subregion is selected from the group consisting of a cermet, aluminum oxide ($Al_2O_3$), zirconium dioxide ($ZrO_2$), an aluminum oxide-containing zirconium oxide (ATZ), a zirconium oxide-containing aluminum oxide (ZTA), an yttrium-containing zirconium oxide (Y-TZP), aluminum nitride (AlN), magnesium oxide (MgO), a piezoceramic, barium (Zr, Ti) oxide, barium (Ce, Ti) oxide and sodium potassium niobate, a platinum alloy, a titanium alloy, a niobium alloy, a tantalum alloy, a molybdenum alloy, a stainless steel (AISI 304, AISI 316 L) and a mixture of at least two thereof.

For the purposes of one embodiment of the invention, a "cermet" is a composite composed of one or more ceramic materials in at least one metallic matrix or a composite composed of one or more metallic materials in at least one ceramic matrix. To produce a cermet, it is possible to use, for example, a mixture of at least one ceramic powder and at least one metallic powder which can be, for example, admixed with at least one binder and optionally at least one solvent. The ceramic constituents and the metallic constituents of the cermet can be selected from among those indicated for the first subregion. A nonmagnetic cermet is a composite composed of a nonmagnetic ceramic and a nonmagnetic metal, as explained below.

In a preferred embodiment of the pump device of one embodiment of the invention, the at least one first subregion comprises a nonmagnetic metal in a proportion of from 40 to 90% by weight, based on the total mass of the at least one first subregion.

Furthermore, the nonmagnetic metal is preferably selected from the group consisting of platinum (Pt), iridium (Ir), niobium (Nb), molybdenum (Mo), tungsten (VV), titanium (Ti), chromium (Cr), tantalum (Ta), zirconium (Zr), alloys of the abovementioned metals, palladium (Pd), gold (Au), nonmagnetic stainless steel (e.g. AISI 304, AISI 316 L) and a mixture of at least two thereof. The nonmagnetic metal can preferably be selected from the group consisting of titanium (Ti), platinum (Pt), tantalum (Ta), niobium (Nb) and a mixture of at least two thereof.

If the content of the nonmetallic metal is below 60% by weight of the first subregion, the further nonmagnetic material can preferably be supplemented by a nonmagnetic ceramic or a nonmagnetic cermet, as described above, to make up at least 60% by weight of nonmagnetic material, based on the total mass of the first subregion.

In a preferred embodiment of the pump device of one embodiment of the invention, the ferromagnetic material of the further subregion is selected from the group consisting of iron (Fe), cobalt (Co), nickel (Ni), chromium dioxide ($CrO_2$), an iron alloy, an iron-nickel alloy, an iron-silicon alloy, an iron-cobalt alloy, a nickel alloy, an aluminum-nickel alloy, a cobalt alloy, a cobalt-platinum alloy, a cobalt-chromium alloy, a neodymium-iron-boron alloy, a samarium-cobalt alloy and a mixture of at least two thereof.

The at least two further subregions of the pump housing preferably have a metal content in the range from 41 to 90% by weight, preferably in the range from 45 to 85% by weight, or in the range from 60 to 80% by weight, based on the total mass of the further subregion.

In a preferred embodiment of the pump device of one embodiment of the invention, at least one of the at least two further subregions further comprises a component selected from among a ceramic, a metal and a mixture thereof. The ceramic is preferably selected from the group of ceramics indicated for the first subregion. Preference is given to at least one of the at least two subregions having the same ceramic as the first subregion. The at least two further subregions preferably comprise the ceramic in a proportion of from 1 to 49% by weight, or preferably in a proportion of from 2 to 45% by weight, or preferably in a proportion of from 5 to 40% by weight, based on the total mass of the respective further subregion. The further metal can comprise a metal which has no ferromagnetic properties. These are preferably the metals which have also been indicated for the first subregion. The sum of all constituents of the further subregion is always 100% by weight.

According to one embodiment of the invention, the pump housing comprises at least one first subregion and at least two further subregions. The pump housing can have a plurality of first subregions and a plurality of further subregions. The pump housing preferably has a number of first subregions in the range from 1 to 10, preferably from 1 to 8, or preferably from 1 to 5. The pump housing preferably has a number of further subregions in the range from 1 to 10, preferably from 2 to 8, or preferably from 2 to 5. The pump housing preferably comprises a first subregion and three further subregions. The at least one first subregion and the at least two further subregions can have the same size or alternatively have different sizes. The at least one first subregion and the at least two further subregions preferably extend over the total thickness of the pump housing wall. The at least one first subregion preferably has a width, based on the longitudinal extension of the pump housing, in the range from 1 to 100 mm, preferably in the range from 2 to 70 mm, and preferably in the range from 3 to 50 mm. The at least two further subregions preferably have a width, based on the longitudinal extension of the pump housing, in the range from 0.5 to 80 mm, preferably in the range from 1 to 60 mm, or preferably in the range from 2 to 20 mm.

In a preferred embodiment of the pump device of one embodiment of the invention, the pump housing has a volume in the range from 0.1 $cm^3$ to 10 $cm^3$, preferably in the range from 0.2 to 9 $cm^3$, or preferably in the range from 0.5 to 5 $cm^3$. The dimensions such as length, diameter and wall thickness of the pump housing are preferably as indicated above. The volume of the pump housing is defined by the interior space surrounded by the pump housing. The wall of the pump housing preferably has a thickness in the range from 0.1 to 5 mm, or preferably in the range from 0.3 to 4 mm, or preferably in the range from 0.4 to 3 mm. In this context, the term wall thickness will be employed in the following. The wall thicknesses can vary in at least one of the first or further subregions on the interior surface of the pump housing. Increasing the wall thickness at at least one point of the pump housing can serve to hold the impeller in position, at least in one direction, in the pump housing.

In a preferred embodiment of the pump device of one embodiment of the invention, the at least one first subregion comprises less than 10% by weight, preferably less than 5% by weight, or preferably less than 3% by weight, based on the total mass of the first subregion, of magnetic metal. The sum of all constituents of the first subregion is always 100% by weight.

The metal of the first subregion is preferably selected from the group consisting of platinum (Pt), iron (Fe), stainless steel (AISI 304, AISI 316 L), iridium (Ir), niobium (Nb), molybdenum (Mo), tungsten (W), titanium (Ti), cobalt (Co), chromium (Cr), a cobalt-chromium alloy, tantalum (Ta) and zirconium (Zr) and a mixture of at least two thereof. The metal is preferably selected from the group consisting of titanium, niobium, molybdenum, cobalt, chromium, tantalum and alloys thereof and a mixture of at least two thereof.

In a preferred embodiment of the pump device of one embodiment of the invention, the third subregion has a metal content which lies between the metal content of the first subregion and the metal content of one of the further subregions. The third subregion can, as a result of the production process for the pump housing, be located between the at least one first subregion and the at least one further subregion. As an alternative, a third subregion can have been introduced at least between a first subregion and a further subregion in the production process. The third subregion preferably comprises a ceramic and a metal. The ceramic is preferably selected from among the ceramics listed for the first subregion. The metal is preferably selected from among the metals listed for the further subregion. The third subregion preferably comprises the ceramic in a proportion of from 10 to 90% by weight, or preferably in a proportion of from 20 to 80% by weight or preferably in a proportion of from 30 to 70% by weight, based on the total mass of the third subregion. The third subregion preferably comprises the metal in a proportion of from 10 to 89% by weight, or preferably in a proportion of from 20 to 80% by weight or preferably in a proportion of from 30 to 70% by weight, based on the total mass of the third subregion. The sum of all constituents of the third subregion is always 100% by weight. The third subregion preferably has a metal content equal to the average of the metal content of the first subregion and of the further subregion. The third subregion can serve to dissipate or minimize tensions between the different materials of the first subregion and of the further subregion. The connection between the first subregion and the third subregion is preferably material-fitting. Furthermore, the connection between the second subregion and the third subregion is preferably likewise material-fitting. The first, the further and the third subregion preferably have the same ceramic or the same ceramics and the same metal or the same metals.

In a preferred embodiment of the pump device of one embodiment of the invention, the pump device has a component housing which is joined in a hermetically sealed manner to the pump housing. At least part of the pump housing is preferably partly surrounded by a component housing. Preference is given to at least part of the at least one first subregion of the pump device being connected to the component housing. The connection of the component housing to at least part of the pump housing preferably leads to a closed space between the component housing and the pump housing. The interior of the component housing or the pump device is preferably hermetically sealed from the environment. The medically implantable pump device proposed here according to one embodiment of the invention can be used, in particular, in a body of a human or animal user, in particular a patient. An implanted pump device is generally exposed to a fluid of a body tissue of the body. It is therefore generally important that neither does body fluid penetrate into the medical implantable apparatus nor do liquids exit from the medically implantable apparatus. To ensure this, the component housing of the medically implantable apparatus, and thus also the component housing and the pump housing of the pump device of one embodiment of the invention, should have very complete impermeability, in particular in respect of body fluids.

The pump device of one embodiment of the invention, in particular connections of component housing to pump housing, are preferably hermetically sealed. Thus, the interior space of the pump device is hermetically sealed from the exterior space. For the purposes of one embodiment of the invention, the term "hermetically sealed" means that, during intended use, no moisture and/or gases can penetrate through the hermetically sealed join over a customary period of 5 years. A physical parameter for determining the freedom from leaks of a connection or a component is the leakage rate. Freedom from leaks can be determined by means of leakage tests. Appropriate leakage tests are carried out using helium leakage testers and/or mass spectrometers and are specified in the standard Mil-STD-883G method 1014. The maximum permissible helium leakage rate is set down as a function of the internal volume of the apparatus to be tested. According to the methods specified in paragraph 3.1 in MIL-STD-883G, method 1014, and taking into account the volumes and cavities of the apparatuses to be tested which occur when the present invention is employed, the maximum permissible helium leakage rate for the pump housing of one embodiment of the invention is $10^{-7}$ atm*cm$^3$/sec or less. This means that the apparatus to be tested (for example the component housing and/or the pump device of one embodiment of the invention or the component housing with the connected pump housing) has a helium leakage rate of less than $1\times10^{-7}$ atm*cm$^3$/sec or less. In a particularly advantageous embodiment, the helium leakage rate is less than $1\times10^{-8}$ atm*cm$^3$/sec, in particular less than $1\times10^{-9}$ atm*cm$^3$/sec. For the purpose of standardization, the helium leakage rates mentioned can also be converted into the equivalent standard air leak rate. The definition of the equivalent standard air leak rate and the conversion calculation are given in the standard ISO 3530.

The pump device of one embodiment of the invention preferably comprises not only the impeller and the pump housing with a first subregion and the at least two further subregions but preferably also a component housing in which further components of the pump device can be present. The further components of the pump device are preferably selected from the group consisting of a battery, a coil, a control unit, a vessel connection unit and a combination of at least two thereof.

In a preferred embodiment of the pump device of one embodiment of the invention, the component housing comprises titanium in a proportion of at least 30% by weight, preferably at least 50% by weight, or preferably at least 80% by weight, in each case based on the total mass of the component housing. It is furthermore preferred that the component housing comprises titanium in a proportion of at least 99% by weight, based on the total mass of the component housing. Furthermore, the component housing can preferably comprise at least one other metal. The other metal can be selected from the same group as the metal of the further subregion. The component housing can preferably comprise the further metal in a proportion of from 1 to 70% by weight, or preferably in a proportion of from 5 to 50% by weight, or preferably in a proportion of from 10 to 20% by weight. The sum of all constituents of the component housing is always 100% by weight. Suitable titanium grades are indicated in ASTM B265-05:2011, for example grades 1 to 6.

In a preferred embodiment of the pump device of one embodiment of the invention, the at least one first subregion of the pump housing has a magnetic permeability of less than 2μ, preferably less than 1.9μ, or preferably less than 1.8μ. The magnetic permeability is determined in accordance with standard ASTM 773-01:2009.

In a preferred embodiment of the pump device of one embodiment of the invention, the surface of the first subregion which faces the interior region of the pump housing has a Vickers hardness of at least 330 HV, preferably at least 350 HV, or preferably at least 370 HV. Preference is given to the entire at least one first subregion having a hardness in the ranges indicated. At least the surface of the at least one further subregion likewise has a Vickers hardness of at least 330 HV, preferably at least 350 HV, or preferably at least 370 HV. The hardness is often not greater than 2000 HV, or preferably not greater than 1500 HV. The hardness of at least the surface of the at least one first subregion is preferably in the range from 330 to 2000 HV, or preferably in the range from 350 to 1800 HV. Furthermore, at least the surface of the at least one first subregion preferably has a hardness which is at least as great as the hardness of the rotor surfaces of the impeller. At least the surface of the at least one first subregion preferably has a hardness which is at least 20 HV greater, or preferably at least 30 HV greater, or preferably at least 40 HV greater, than the Vickers hardness of the rotor surfaces of the impeller. For the purposes of one embodiment of the present invention, the surface of the at least one subregion, of the at least one further subregion and of the impeller is the material layer close to the surface in a region from 0.01 to 2.5 mm, preferably in a region from 0.05 to 1.0 mm, or preferably in a region from 0.1 to 0.5 mm, in each case perpendicular to the surface.

In a preferred embodiment of the pump device of one embodiment of the invention, at least the outer surfaces of the component housing and the surface facing the interior region of the pump housing are biocompatible. This is particularly preferred when the pump device is destined for implantation in a living body, for example that of a human being or animal. The biocompatibility is determined and assessed in accordance with the standard ISO 10993-4:2002.

In general, the surfaces facing the interior region of the pump housing and the outer surfaces of the component housing come into contact with the body fluid of a living body after implantation of the pump device of one embodiment of the invention in this body. The biocompatibility of the surfaces which come into contact with body fluid contributes to the body not suffering damage on contact with these surfaces.

One aspect of the present invention further provides a process for producing a pump housing for a pump device, which comprises the steps:

a. Provision of a first material;

b. Provision of a further material c. Formation of a pump housing precursor, wherein at least one first subregion of the pump housing is formed by the first material, and wherein at least two further subregions of the pump housing are formed by the further material;

d. Treatment of the pump housing precursor at a temperature of at least 300° C.

The provision of the first material in step a. and of the further material in step b. can be carried out in any way which a person skilled in the art would select for this purpose.

The formation of the pump housing precursor can be carried out in any way which a person skilled in the art would select for the purpose of forming a first subregion and at least two further subregions.

In a preferred embodiment of the process, step c. comprises a shaping process, preferably selected from the group consisting of a lithographic process, injection molding, a machining process, extrusion and a combination of two or more thereof.

In a lithographic process, various layers of one or more materials are shaped in succession. The lithographic process preferably corresponds to a layerwise screen printing process. In a screen printing process, a screen consisting of a very dimensionally stable material such as wood, metal, preferably steel, a ceramic or a plastic and having a selected mesh opening is arranged on the object to be covered or over the object to be covered. The printing composition used for application or covering, for example in the form of a paste or a powder, is applied to this screen via a nozzle or from a vessel and pushed by means of a doctor blade through the mesh openings of the screen. Here, different amounts of printing composition used for application or covering can be applied to different places as a result of a pattern in the screen. Thus, by means of the geometry and arrangement of the mesh openings, either a uniform film of the printing composition used for covering can be applied or regions having no or little printing composition used for application can alternate with regions having a large amount of printing composition used for application. Preference is given to a uniform film of the printing composition used for covering being transferred onto the surface. The mesh openings of the screen can also be partly closed by appropriately applied materials (photoresistor layers, screen printing templates) so that the printing composition is transferred onto the surface to be coated only in defined regions having open mesh orifices in order to obtain, for example, a defined structure such as a pattern. Furthermore, thin films having defined openings (stencils) can also be used instead of screens for transferring the printing composition. Repetition of this procedure using one and the same material or else different materials makes it possible to obtain 3-D structures.

Injection molding, also referred to as injection molding process, is a shaping process for at least one material used to obtain a shaped solid. A person skilled in the art will know of various injection molding processes and tools and conditions used for injection molding from the prior art. The injection molding process can be selected from the group consisting of multicomponent injection molding, powder injection molding, spray embossing, extrusion injection molding, subatmospheric injection molding and a combination of at least two thereof.

Machining can be combined with any other shaping process. Machining involves structuring a solid body through use of machining tools such as a drill or a punch. During structuring, a part of the material is removed. In this way, solid bodies can be converted, for example, into hollow bodies. For example, a hollow space can be formed in the pump housing precursor by machining when the pump housing precursor is configured as a solid body. However, machining can also be a treatment step after production of a pump housing or housing. In addition to cutting machining, polishing can also take place after the production of the pump housing.

In the formation of the pump housing precursor in step c., a first material for forming a first subregion is brought into contact with a further material for forming the further subregion. Contacting preferably takes place in the form of injection molding, in which firstly the further material is injected into a metal mold and the first material is subsequently injected. The ratios of the first and further materials preferably correspond to the ratios in the first subregion and in the further subregion, as has been described above in connection with the first subject, i.e., the pump device of one embodiment of the invention. Furthermore, the first material and the further material can contain additives. The pump housing precursor preferably has the shape of the pump housing immediately after contacting. The two materials preferably form a continuous shape. Contacting can comprise one or more further steps. Thus, a third material, which preferably has a composition like the third subregion of the above-described pump device of one embodiment of the invention, can be inserted between the first material and the further material in the pump housing precursor.

As additive, it is possible to select any substance which a person skilled in the art would select as additive for the first material. The additive is preferably selected from the group consisting of water, a dispersant, a binder and a mixture of at least two thereof.

The dispersant preferably comprises at least one organic substance. The organic substance preferably has at least one functional group. The functional group can be a hydrophobic functional group or a hydrophilic functional group. The functional group can be selected from the group consisting of an ammonium group, a carbon/late group, a sulfate group, a sulfonate group, an alcohol group, a polyalcohol group, an ether group and a mixture of at least two thereof. The dispersant preferably has from 1 to 100, or preferably from 2 to 50, or preferably from 2 to 30, functional groups. Preferred dispersants are obtainable under the trade names DISPERBYK® 60 from Byk-Chemie GmbH and DOLAPIX CE 64 from Zschimmer & Schwarz GmbH & Co KG.

The binder is preferably selected from the group consisting of a methylcellulose, a thermoplastic polymer, a thermoset polymer and a wax and a mixture of at least two thereof.

The methylcellulose is preferably selected from the group consisting of hydroxylpropylmethylcellulose (HPMC), hydroxyethylmethylcellulose (HEMC), ethylmethylcellulose (EMC) and a mixture thereof. The methylcellulose preferably comprises hydroxypropylmethylcellulose (HPMC). Further preferably, the methylcellulose comprises hydroxypropylmethylcellulose in a proportion of from 80 to 100% by weight, or preferably in a proportion of from 90 to 100% by weight, or preferably in a proportion of from 95 to 100% by weight, based on the total mass of methylcellulose. The methylcellulose preferably has a proportion of —$OCH_3$ groups in the range from 20 to 40% by weight, or preferably in the range from 23 to 37% by weight, or preferably in the range from 25 to 35% by weight, based on the total mass of methylcellulose. Furthermore, the methylcellulose preferably has a proportion of —$OC_3H_6OH$ groups in the range from 1 to 12% by weight, or preferably in the range from 3 to 9% by weight, or preferably in the range from 4 to 8% by weight, based on the total mass of methylcellulose.

The thermoplastic polymer can be selected from the group consisting of acrylonitrilo-butadiene-styrene (ABS), polyamides (PA), polylactate (PLA), polymethyl methacrylate (PMMA), polycarbonate (PC), polyethylene terephthalate (PET), polyethylene (PE), polypropylene (PP), polystyrene (PS), polyether ether ketone (PEEK) and polyvinyl chloride (PVC) and a mixture of at least two thereof. The thermoset polymer can be selected from the group consisting of an aminoplastic, an epoxy resin, a phenolic resin, a polyester resin and a mixture of at least two thereof. Waxes are hydrocarbon compounds which melt without decomposition above 40° C. These can include polyesters, paraffins, polyethylenes or copolymers of at least two thereof.

The first material preferably comprises at least one of the abovementioned additives in a proportion of from 0.1 to 10% by weight, or preferably in a proportion of from 0.2 to 8% by weight, or preferably in a proportion of from 0.5 to 5% by weight, based on the total mass of the first material.

The further material preferably comprises at least one of the abovementioned additives in an amount of from 0.1 to 5% by weight, or preferably in an amount of from 0.2 to 2% by weight, or preferably in an amount of from 0.3 to 1% by weight, in each case based on the total weight of the further material.

The treatment of the pump housing precursor in step d. can be carried out in any way which a person skilled in the art would choose for the purpose of heating the pump housing precursor to at least 300° C. Preference is given to at least part of the treatment of the pump housing precursor taking place at a temperature in the range from 300 to 2500° C., or in the range from 500 to 2000° C., or in the range from 700 to 1800° C. During the treatment of the pump housing precursor at elevated temperature, at least part of the binder preferably escapes. Various temperature profiles are possible during the treatment in step d. of the pump housing precursor from step c. The treatment of the pump housing precursor can, for example, be carried out in an oxidative atmosphere, a reductive atmosphere or under a protective atmosphere. An oxidative atmosphere can, for example, contain oxygen, e.g. air or an oxygen/air mixture. A reductive atmosphere can, for example, contain hydrogen. A protective atmosphere preferably comprises neither oxygen nor hydrogen. Examples of protective atmospheres are nitrogen, helium, argon, krypton and mixtures thereof. The choice of the atmosphere can be dependent on the materials to be treated. A person skilled in the art will be familiar with the suitable choice of the atmosphere for the materials mentioned. It can also be preferred for combinations of different atmospheres to be selected in succession for various periods of time.

The treatment of the pump housing precursor can be carried out either in one step or preferably in more than one more step. The pump housing precursor is preferably treated at a temperature in the range from 301 to 600° C., or preferably in the range from 350 to 550° C., or preferably in the range from 400 to 500° C., in a first substep of step d. This first substep of the treatment step d. can be carried out over a period of time in the range from 1 to 180 minutes, preferably in the range from 10 to 120 minutes, or preferably in the range from 20 to 100 minutes. This substep can be carried out either by introduction of the pump housing precursor from step c. into a preheated atmosphere or by slow stepwise or continuously increased heating of the pump housing precursor. The treatment of the pump housing precursor in the first substep of step d. is preferably carried out in one step at a temperature in the range from 301 to 600° C.

In a second substep of the treatment in step d., which preferably follows the first substep, the pump housing precursor is preferably heated to a temperature in the range from 800 to 2500° C., or preferably in the range from 1000 to 2000° C., or preferably in the range from 1100 to 1800° C. This substep, too, can be effected either by introducing the pump housing precursor from the first substep of step d. into a preheated atmosphere or by slow stepwise or continually increased heating of the pump housing precursor. The treatment of the pump housing precursor in the second substep of step d. is preferably carried out in one step at a temperature in the range from 800 to 2500° C. The treatment of the pump housing precursor in the second substep is carried out over a period of time in the range from 1 to 180 minutes, preferably in the range from 10 to 120 minutes, or preferably in the range from 20 to 100 minutes.

The shape of the pump housing after the production process is preferably continuous. This means that the pump housing has no further openings or outlets or other cut-outs apart from the outlet and the inlet. The pump housing preferably has a straight outer surface. The wall thicknesses can vary in at least one of the first or further subregions on the interior surface of the pump housing. An increase in the wall thickness at at least one point on the pump housing can serve to hold the impeller in position, at least in one direction, in the pump housing. The thickening of the wall thickness can take place either during the production process or subsequently thereto. In addition or as an alternative thereto, the pump housing can have constrictions.

A pump device according to one embodiment of the invention is obtainable by insertion of an impeller into a pump housing, arrangement of electromagnets with coils around the pump housing, and establishment of an electric circuit with inclusion of a control device and a power source, e.g. a battery. Preference is given to the pump device of one embodiment of the invention being surrounded by a component housing and the further subregions of the pump housing being connected to the component housing in a material-fitting manner. This can be effected, for example, by means of a soldered connection along the point of contact of pump housing and component housing.

One aspect of the present invention further provides a pump housing for a pump device obtainable by the above-described process of the invention.

One aspect of the present invention further provides a housing which at least partly surrounds an interior region and has a first end and a second end, wherein the wall of the housing has at least one first subregion and at least one further subregion in at least one plane perpendicular to the longitudinal extension of the housing;

wherein the at least one first subregion comprises at least 60% by weight, based on the total mass of the at least one first subregion, of at least one nonmagnetic material, wherein the at least one further subregion comprises at least 41% by weight, based on the total mass of the at least one further subregion, of at least one ferromagnetic material, wherein the at least one further subregion in the plane and the at least one first subregion in the plane are adjacent, and wherein the at least one first subregion and the at least one further subregion are connected to one another in a material-fitting manner.

The housing corresponds, in terms of its shape, its composition and its further configuration, to the pump housing which has been described above in connection with the pump device of one embodiment of the invention.

In a preferred embodiment of the housing, a shiftable element is provided in the housing at least in one part of the housing. Further preferred embodiments correspond to the above-described embodiments of the pump device of one embodiment of the invention.

The shiftable element can be selected from the group consisting of a sphere, a cylinder, an air bubble and a combination of at least two thereof. The shiftable element preferably has a shape which corresponds to the diameter of the pump housing. The material of the shiftable element can be any material which a person skilled in the art would use for this purpose. The shiftable element preferably comprises a metal, a polymer, a ceramic or a mixture thereof. The metal or the polymer can be selected from among a metal, a polymer and a ceramic as have been described for the first subregion of the pump housing. The shiftable element can be shifted in terms of its position in the housing, for example by changing the fluid flow in the housing. When the position of the shiftable element is altered, a flow of current in a coil can be triggered and recorded by means of a current flow measurement.

One aspect of the present invention further provides a pump device comprising at least one above-described housing or a pump housing obtainable by a process as described above.

Measurement Methods

1. Determination of the Vickers hardeners (HV):

The testing forces and materials were determined in accordance with the standard DIN EN ISO 657 March 2006. The following testing forces and durations of action were used: 1 kg, 15 seconds. The testing temperature was 23° C.±1° C.

2. Determination of the magnetic permeability: The magnetic permeability was determined in accordance with the standard ASTM A773/A773-01(2009)

3. Determination of the biocompatibility:

The biocompatibility is determined in accordance with the standard 10993-4:2002.

4. Determination of the hermetic connection:

Leakage tests are carried out using helium leakage testers and/or mass spectrometers. A standard measurement method is specified in the standard Mil-STD-883G method 1014. The maximum permissible helium leakage rate is set down as a function of the internal volume of the apparatus to be tested. According to the methods specified in paragraph 3.1 of MIL-STD-883G, method 1014, and taking into account the volumes and cavities in the apparatuses to be tested which occur when the present invention is employed, the maximum permissible helium leakage rate for the pump housing of one embodiment of the invention is $10^{-7}$ atm*cm$^3$/sec or less. This means that the apparatus to be tested (for example the component housing and/or the pump device or the component housing with the connected pump housing) has a helium leakage rate of less than $1\times10^{-7}$ atm*cm$^3$/sec or less. For comparative purposes, the above-mentioned helium leakage rates can also be converted into the equivalent standard air leak rate. The definition of the equivalent standard air leak rate and the conversion calculation are given in the standard ISO 3530.

5. Determination of the roughness: DIN EN ISO 4288. Further parameter data: Maximum probe tip radius=2 μm; measurement distance=1.25 mm; wavelength limit=250 μm.

EXAMPLES

Example 1 for First Material

The first material contains 45% by weight of platinum powder from Heraeus Precious Metals GmbH & Co.KG having a particle size $D_{50}$=50 μm and 45% by weight of aluminum oxide ($Al_2O_3$) from CeramTech GmbH having a particle size of $D_{90}$=2 μm and 10% by weight of a binder METAWAX P-50 obtainable from Zschimmer & Schwarz GmbH & Co.KG.

Example 2 for Further Material

The further material contains a mixture of 45% by weight of a Pt—Co-23 material from Heraeus Holding GmbH and 45% by weight of aluminum oxide ($Al_2O_3$) obtainable from CeramTech GmbH, and 10% by weight of the binder METAWAX P-50 obtainable from Zschimmer & Schwarz GmbH & Co.KG.

Example 3 for First Subregion

The first material contains 50% by weight of platinum powder from Heraeus Precious Metals GmbH & Co.KG and 50% by weight of aluminum oxide ($Al_2O_3$) from CeramTech GmbH.

Example 4 for Further Subregion

The further material contains a mixture of 50% by weight of a Pt—Co-23 material from Heraeus Holding GmbH and 50% by weight of aluminum oxide ($Al_2O_3$) obtainable from CeramTech GmbH.

If not specified here, the particle sizes of the materials can be taken from the product data sheet which is available from raw materials suppliers and often accompanies a delivery.

The first material as per example 1 is firstly provided in a vessel, according to the process of one embodiment of the invention for producing a pump housing. The further material as per example 2 is likewise provided in a vessel. In an alternating sequence, the powders of the further material and of the first material can be introduced into the mold as shown in FIG. 5 and pressed together by means of a punch. This gives a pump housing precursor which is firstly treated at a temperature of 400° C. in a furnace and subsequently sintered at a temperature of 1700° C. in order to give a pump housing having at least one first subregion having the composition as per example 3 and at least one further subregion having the composition as per example 4.

FIG. 1 schematically shows a pump device 10 which has a pump housing 20 in the form of a tube and also a component housing 40. The outer surfaces 100 of the component housing 40 come, particularly in the case of an implantable pump device 10, into contact with the body and are therefore preferably made biocompatible. The pump housing 20 has a wall 21 which surrounds an interior region 50. The surface of the pump housing 20 which faces the interior region 50 is referred to as facing surface 102. The facing surface 102 comes into contact with the fluid and is therefore preferably made biocompatible, especially for an implantable pump device 10. In the interior region 50 of the pump housing 20, there is at least one impeller 80; in this case, two impellers 80 are present in the pump housing 20. The pump housing 20 has a first subregion 26 in the middle of the wall 21. At the first end 22, which at the same time defines the inlet 22 through the opening 23, the wall 21 or the pump housing 20 has a first further subregion 28. On the opposite side of the pump housing 20, there is the further end 24, in the form of the outlet 24, comprising the further opening 25. A fluid can be pumped in the pumping direction 240 from the inlet 22 to the outlet 24 by means of the impeller 80. Further components such as a battery 120 and a control unit 130 are located between the component housing 40 and the pump housing. Furthermore, two coils 32 and 32' are present in the component housing 40. The coils 32 and 32' can either be arranged around the at least two further subregions 28, 28' or be located at another place in the component housing 40. The further subregions 28, 28' are configured as protuberances from the otherwise tubular pump housing 20.

Figure 2:
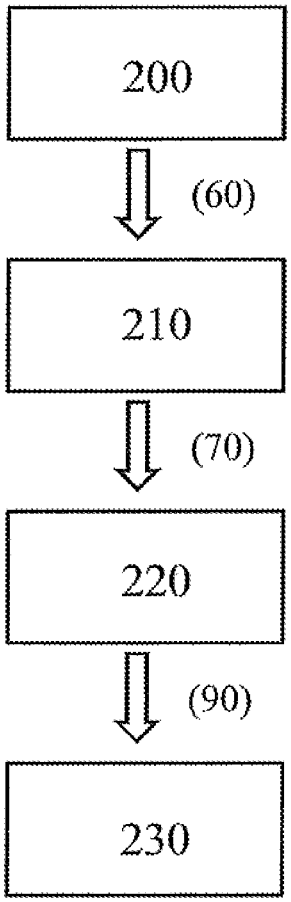
FIG. 2 illustrates a flow diagram of a process for producing a pump housing according to one embodiment of the invention.

FIG. 2 shows a schematic flow diagram for the process for producing a pump housing. In step a. or a) 200, a first material 60 is provided. The first material 60 is, for example, a mixture of at least two powders. The first material contains the composition as per example 1.

The further material 70 is provided in the form of a mixture as per example 2. The vessel can be a metal vessel having a screen outlet. The powder particles preferably have a round to oval shape. The particle size $D_{50}$ means that not more than 50% of the particles are larger than the diameter indicated. The particle size $D_{90}$ means that not more than 90% of the particles are larger than the diameter indicated. The particle size can be determined by various methods. The particle size is preferably determined by means of laser light scattering, optical microscopy, optical counting of individual particles or a combination of at least two thereof. Furthermore, the determination of the particle size is preferably carried out like the particle size distribution by means of optical individual analysis of transmission electron micrographs (TEM).

In a step c or c) 220, a pump housing precursor 90 is formed from the first material 60 and the further material 70.

Steps c. and c) 200 are two alternatives which can be employed in the formation of the pump housing precursor 90. In the first alternative of step c., a further subregion 28 is firstly formed by the further material 70. Here, the further material 70 is pressed by means of a Teflon doctor blade having the dimensions 10 mm*4 mm*2 mm and a doctor blade hardness of 50 shore into a first mold made of an aluminum oxide ceramic. The first mold is open on one side. The first material 60 is subsequently pressed into a further mold as described for the further material. The further mold is also open on one side. The first and the further material 70 are pressed together by means of a stainless steel punch under the pressure of a weight of 10 kg. Two blanks are formed and these are treated at a temperature of 400° C. for 10 hours in a furnace from Heraeus Holding GmbH.

The two blanks are subsequently connected together at the open sides of the mold to give a pump housing precursor 90. The pump housing precursor is treated at a temperature of 400° C. in air. This treatment takes place in a furnace from Heraeus Holding GmbH for a period of 160 minutes. Immediately after this treatment step, the pump housing precursor 90 is treated at a temperature of 1700° C. for 180 minutes in the same furnace, resulting in the subregions 26, 28 sintering together and a pump housing being formed. This gives a pump housing in the form of a round tube made up of at least one first subregion and protuberances at least of two further subregions. The internal diameter of the pump housing is 9 mm.

Figure 3A:
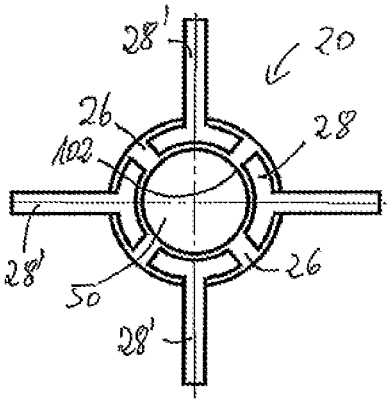
FIGS. 3*a-b* schematically illustrates a pump housing according to one embodiment of the invention having a first subregion and a further subregion which are arranged directly adjacent to one another.

FIG. 3*a* shows a cross section (in a plane Q) through a pump housing 20 produced as above. The core of the tubular pump housing 20 is formed by a first subregion 26 into which many further subregions 28 and 28' project. The further subregions 28 and 28' form protuberances on the pump housing 20 in all four directions in space. The surface of the interior region 50, and consequently the surface 102 facing the interior region 50, is in this embodiment formed exclusively by a first subregion 26.

Figure 3B:
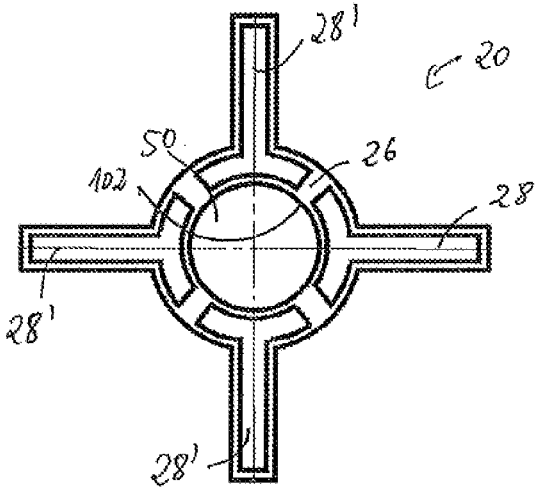

FIG. 3*b* likewise shows a cross section (in the plane Q) through a pump housing 20 according to one embodiment of the invention. The arrangement of the further subregions 28 and 28' is identical to that in FIG. 3*a* and the subregions project outward from the tubular main element of the pump housing in all four directions in space. Unlike the further subregions 28, 28' in FIG. 3*a*, the further subregions 28, 28' in the embodiment as per FIG. 3*b* are surrounded by the first subregion 26. This results in the entire outer surface of the pump housing 20 comprising the first subregion 26.

Figure 4A:
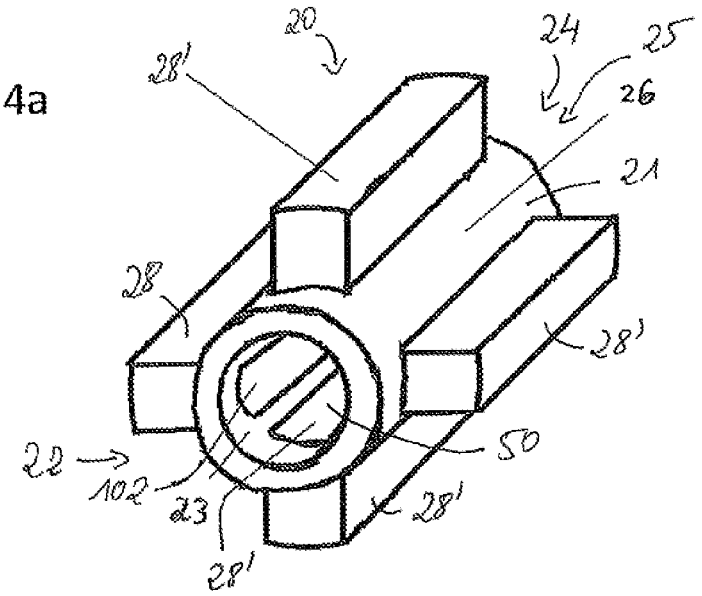
FIGS. 4*a-b* schematically illustrates a pump housing according to one embodiment of the invention having a first subregion and a further subregion which are separated by a third subregion.

FIG. 4*a* once again shows a pump housing 20 having protuberances from the tubular main element of the pump housing 20. Here, the further subregions 28 and 28' all project through the wall thickness of the pump housing 20 into the interior region 50. The interior region 50 consequently has both parts of the first subregion 26 and also parts of further subregions 28, 28' on its facing surface 102. The first subregion 26 projects beyond the further subregions 28, 28' at the inlet 22 and the outlet 24.

Figure 4B:
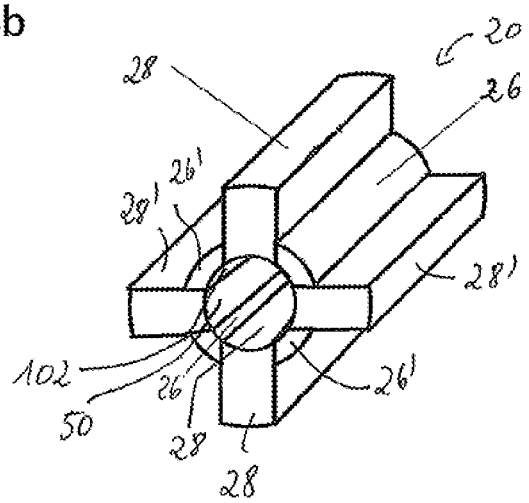

The embodiment of FIG. 4*b* has the same shape and arrangement of the first subregion 26 and the further subregions 28, 28', with the difference that the further subregions 28 and 28' alternate on the circumference of the pump housing 20. This has the consequence that both types of subregions, i.e. both at least one first subregion 26 and also at least the two subregions 28, 28', end at the first opening 23 at the inlet 22 and at the further opening 25 at the outlet 24.

The invention claimed is:

1. A pump device comprising:

a pump housing comprising a wall surrounding an interior region and having an inlet and an outlet;

an impeller provided in the interior region of the pump housing;

wherein the wall of the pump housing has at least one first subregion and at least two further subregions in at least one plane perpendicular to the longitudinal extension of the pump housing and wherein the at least one first subregion and at least one further subregion alternate on a circumference of the pump housing;

wherein the at least one first subregion comprises at least 60% by weight, based on the total mass of the at least one first subregion, of at least one nonmagnetic material;

wherein the further subregions comprise at least 41% by weight, based on the total mass of the further subregions, of at least one ferromagnetic material;

wherein each further subregion is adjacent to at least one first subregion in the plane; and wherein the at least one first subregion and the further subregions are connected to one another in a material-fitting manner.

2. The pump device of claim 1, wherein at least part of each further subregion is in each case surrounded by at least one electric coil.

3. The pump device of claim 1, wherein the nonmagnetic material of the at least one first subregion is selected from the group consisting of a cermet, aluminum oxide ($Al_2O_3$), zirconium dioxide ($ZrO_2$), an aluminum oxide-containing zirconium oxide (ATZ), a zirconium oxide-containing aluminum oxide (ZTA), an yttrium-containing zirconium oxide (Y-TZP), aluminum nitride (AlN), magnesium oxide (MgO), a piezoceramic, sodium potassium niobate, a platinum alloy, a titanium alloy, a niobium alloy, a tantalum alloy, a molybdenum alloy, a stainless steel (AISI 304, AISI 316 L) and a mixture of at least two thereof.

4. The pump device of claim 1, wherein the at least one first subregion comprises a nonmagnetic metal in a proportion of from 40 to 90% by weight, based on the total mass of the at least one first subregion.

5. The pump device of claim 1, wherein the ferromagnetic material of the further subregion is selected from the group consisting of iron (Fe), cobalt (Co), nickel (Ni), chromium dioxide ($CrO_2$), ferrite (Fe2O3), an iron alloy, an iron-nickel alloy, an iron-silicon alloy, an iron-cobalt alloy, a nickel alloy, an aluminum-nickel alloy, a cobalt alloy, a cobalt-platinum alloy, a neodymium-iron-boron alloy, a samarium-cobalt alloy and a mixture of at least two thereof.

6. The pump device of claim 1, wherein at least one of the at least two further subregions further comprises a component selected among a ceramic and a metal and a mixture thereof.

7. The pump device of claim 1, wherein the at least one first subregion comprises less than 10% by weight, based on the total mass of the first subregion, of magnetic metal.

8. The pump device of claim 1, wherein the pump housing has a volume in the range from 0.1 $cm^3$ to 10 $cm^3$.

9. The pump device of claim 1, wherein the pump device has a component housing which is connected in an impermeable manner to the pump housing.

10. The pump device of claim 9, wherein the component housing comprises at least 30% by weight, based on the total mass of the component housing, of titanium.

11. The pump device of claim 1, wherein at least the outer surface of the component housing and the surface facing the interior region of the pump housing are biocompatible.

12. A pump housing obtained by a method comprising:

providing a first material;

providing a further material;

forming a pump housing precursor;

wherein at least one first subregion of the pump housing is formed by the first material; and wherein at least two further subregions of the pump housing are formed by the further material;

wherein the at least one first subregion and at least one further subregion alternate on a circumference of the pump housing; and heating the pump housing precursor at a temperature of at least 300° C.

13. The pump housing as claimed in claim 12, wherein forming a pump housing precursor comprises a shaping process, selected from the group consisting of a lithographic process, injection molding, cutting machining, extrusion and a combination of at least two thereof.

14. A housing comprising a wall surrounding an interior region, wherein the housing has an inlet and an outlet, wherein the wall of the housing has at least one first subregion and at least one further subregion in at least one plane perpendicular to the longitudinal extension of the housing and wherein the at least one first subregion and the at least one further subregion alternate on a circumference of the pump housing;

wherein the at least one first subregion comprises at least 60% by weight, based on the total mass of the at least one first subregion, of at least one nonmagnetic material, wherein the at least one further subregion comprises at least 41% by weight, based on the total mass of the at least one further subregion, of at least one ferromagnetic material, wherein the at least one further subregion in the plane and the at least one first subregion in the plane are adjacent and wherein the at least one first subregion and the at least one further subregion are connected to one another in a material-fitting manner.

15. The housing of claim 14, wherein a shiftable element is provided in the housing at least in a part of the housing.

16. A pump device comprising at least one housing as claimed in claim 14.

* * * * *